US005782672A

United States Patent [19]

Woodley

[11] Patent Number: 5,782,672

[45] Date of Patent: Jul. 21, 1998

[54] NIPPLE PAD

[76] Inventor: Vickie G. Woodley, 405 S. West, New Boston, Tex. 75570

[21] Appl. No.: 805,236

[22] Filed: Feb. 24, 1997

Related U.S. Application Data

[60] Provisional application No. 60/018,476, May 28, 1996.

[51] Int. Cl.[6] ..... A41C 3/12

[52] U.S. Cl. ..... 450/57; 450/93; 450/81; 2/267

[58] Field of Search ..... 450/81, 53, 54, 450/55, 56, 57, 37, 30, 31, 32; 2/267, 463, 2.5, 15, 464, 455, 456, 73

[56] References Cited

U.S. PATENT DOCUMENTS

| | | | |
|---|---|---|---|
| D. 234,445 | 3/1975 | Greenblatt et al. . | |
| D. 246,729 | 12/1977 | Murphy . | |
| D. 270,576 | 9/1983 | Thompson . | |
| 2,047,522 | 7/1936 | Schnaittacher | 450/37 |
| 2,165,668 | 7/1939 | Vaccaro | 2/15 |
| 2,440,466 | 4/1948 | Freedman | 450/37 |
| 2,525,601 | 7/1950 | Hughes | 2/267 |
| 2,527,947 | 10/1950 | Loos | 2/15 |
| 2,543,104 | 2/1951 | Goldeng | 2/15 |
| 2,553,825 | 7/1951 | Langs . | |
| 2,572,638 | 10/1951 | Loos | 2/15 |
| 2,594,549 | 4/1952 | Flores et al. | 450/54 |
| 2,664,571 | 1/1954 | Kempel . | |
| 3,068,863 | 12/1962 | Bowman | 2/15 |
| 3,092,103 | 6/1963 | Mower | 2/15 X |
| 3,878,568 | 4/1975 | Connelly . | |
| 4,333,471 | 6/1982 | Nakai | 450/81 |
| 4,640,288 | 2/1987 | Hattori | 450/81 |
| 4,674,131 | 6/1987 | Broel . | |
| 4,793,003 | 12/1988 | Riedel et al. | 2/15 |
| 4,870,977 | 10/1989 | Imonti . | |
| 4,951,658 | 8/1990 | Morgan et al. | 2/15 |
| 4,992,074 | 2/1991 | Diaz . | |
| 5,017,714 | 5/1991 | Gowrylow . | |
| 5,180,360 | 1/1993 | Rhame, Jr. | 2/15 |
| 5,263,200 | 11/1993 | Miller | 2/15 |
| 5,326,305 | 7/1994 | Fochler . | |
| 5,389,066 | 2/1995 | Rhame, Jr. | 2/15 |

*Primary Examiner*—Jeanette E. Chapman
*Attorney, Agent, or Firm*—Richard C. Litman

[57] ABSTRACT

A nipple pad for protecting and concealing the nipple and areola of a woman's breast includes a pliable cover, a padded liner, adhesive strips, and a release liner. The padded liner is affixed to a central portion of the cover. The adhesive strips are attached to the periphery of the cover, concentrically surrounding the padded liner. The release liner is attached to the adhesive strip for covering and protecting both the adhesive strip and the padded liner. The central portion of the cover and the padded liner have a concave shape for receiving the nipple, resulting in enhanced contouring and softening thereof. The padded liner has an increasing thickness from the periphery to the central portion of the cover, resulting in maximum contouring and softening of the nipple.

4 Claims, 2 Drawing Sheets

NIPPLE PAD

CROSS-REFERENCE TO RELATED APPLICATION

This application claims the benefit of U.S. Provisional patent application Ser. No. 60/018,476 filed May 28, 1996.

BACKGROUND OF THE INVENTION

1. Field of the Invention

The present invention relates to an article of apparel and more particularly to a device for protecting and covering the nipple and areola of a woman's breast.

2. Description of the Prior Art

Although many devices are currently available that permit women to lift, support, cover, and augment their breasts, none provide the freedom and stylish comfort of the present invention. Today, women desire the freedom and flexibility to clad and adorn themselves in a manner that permits greater self expression and individuality.

Furthermore, modern women want to have a choice to flatter their natural beauty in a way that is tasteful, yet not excessively provocative. As dress styles for work and play become more casual and sensual, the present invention provides just such a choice. At last, women can use the present invention and be assured of the necessary modicum of modesty, without wearing the traditional, uncomfortably restrictive undergarments that have confining ribbons and straps.

Numerous U.S. design patents describe devices and undergarments for women that are intended to cover the entire breast. For example, U.S. Pat. No. Des. 234,445 issued to Greenblatt et al. on Mar. 11, 1975, discloses the design for a brassiere pad. The Greenblatt et al. patent discloses a padded cup intended to support and cover the entire breast. In contrast, the present invention is not intended to cover the entire breast or serve the supporting function of a brassiere. Similarly, U.S. Pat. No. Des. 246,729 issued to Murphy on Dec. 20, 1977, discloses a combined breast shield and milk collector that covers the entire breast. Murphy does not show or suggest an article of apparel that is intended to cover and conceal just the nipple and areola of a woman's breast.

Other design patents describe articles that are not intended to be worn underneath garments. For example, U.S. Pat. No. Des. 270,576 issued to Thompson on Sep. 13, 1983, discloses an electronic flashing pastie.

Several U.S. utility patents also disclose various articles of apparel that cover the entire breast, for instance, U.S. Pat. Nos.: 2,553,825 issued to Langs on May 22, 1951; 2,664,571 issued to Kempel on Jan. 5, 1954; 3,878,568 issued to Connelly on Apr. 22, 1975; 4,674,131 issued to Broel on Jun. 23, 1987; 4,870,977 issued to Imonti on Oct. 3, 1989; 4,992,074 issued to Diaz on Feb. 12, 1991; 5,017,174 issued to Gowrylow on May 21, 1991; and 5,326,305 issued to Fochler on Jul. 5, 1994.

Langs discloses a breast cover that includes an adhesive strip for attaching the cover to the breast. Conversely, the present invention does not cover the entire breast, but is specifically adapted to avoid hiding or reconfiguring the natural beauty of a woman's breasts. Similarly, Kempel discloses a padding device worn with a brassiere that augments volume and adjusts position of the breasts.

Connelly discloses a prosthesis for women who have endured cancer and have undergone a radical mastectomy. Broel discloses a foam pad which is intended to be sewn into the lining of garments for smoothing the contours of the bosom. Imonti discloses a surgical device having a cone-shaped nipple protector. The device of Imonti is used to reconstruct a nipple after a mastectomy.

Gowrylow discloses a nursing pad that includes layers of absorbent material. The pad is worn inside a brassiere in order to absorb milk excreted from the nipples of a woman who is nursing. Diaz discloses a reusable self-supporting brassiere, which includes self adhesive strips, that augments and reconfigures the breasts. Finally, Fochler discloses a protective breast pad with an adhesive strip and protective cover.

All of the above referenced patents describe articles that are intended to augment or reconfigure the natural shape and beauty of a woman's breast. In contrast, the primary objective of the present invention is to permit a woman to attractively and tastefully display her naturally endowed beauty. As such, the above recited art tends to teach away from the present invention.

Furthermore, none of the above inventions and patents, taken either singly or in combination, is seen to describe the instant invention as claimed. Thus a nipple pad solving the solving the aforementioned problems is desired.

SUMMARY OF THE INVENTION

The present invention is a nipple pad for protecting and covering the nipple and areola of a woman's breast. The nipple pad has a pliable cover with an outer surface and an opposite inner surface. The inner surface has an edge and a central portion. A padded liner covers and is continuously connected to the central portion of the inner surface. An adhesive strip is affixed to the edge of the inner surface. A release liner is attached to the adhesive strip, serving to protect the padded liner.

The pliable cover is shaped to conform to the nipple and areola of a woman's breast. The cover is made from a supple and elastic material such as latex or other polymeric material. The padded liner is made from a soft, breathable material, such as gauze or latex foam, which protects the nipple and areola while softening the contours of the nipple. The adhesive material is specifically chosen to permit removal of the nipple pad without leaving an unsightly residue and without inducing pain to the sensitive tissue of the nipple and areola.

Accordingly, it is a principal object of the invention to provide a nipple pad that enhances the natural beauty of a woman's breasts and softens the contours of the nipples.

It is another object of the invention to provide the user an alternative to using a traditional brassiere by tastefully concealing the nipples.

It is a further object of the invention to provide a nipple pad that has self-adhesive strips which permit the nipple pad to be removed painlessly and without leaving an uncomfortable residue.

It is an object of the invention to provide improved elements and arrangements thereof in an apparatus for the purposes described which is inexpensive, dependable and fully effective in accomplishing its intended purposes.

These and other objects of the nipple pad will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
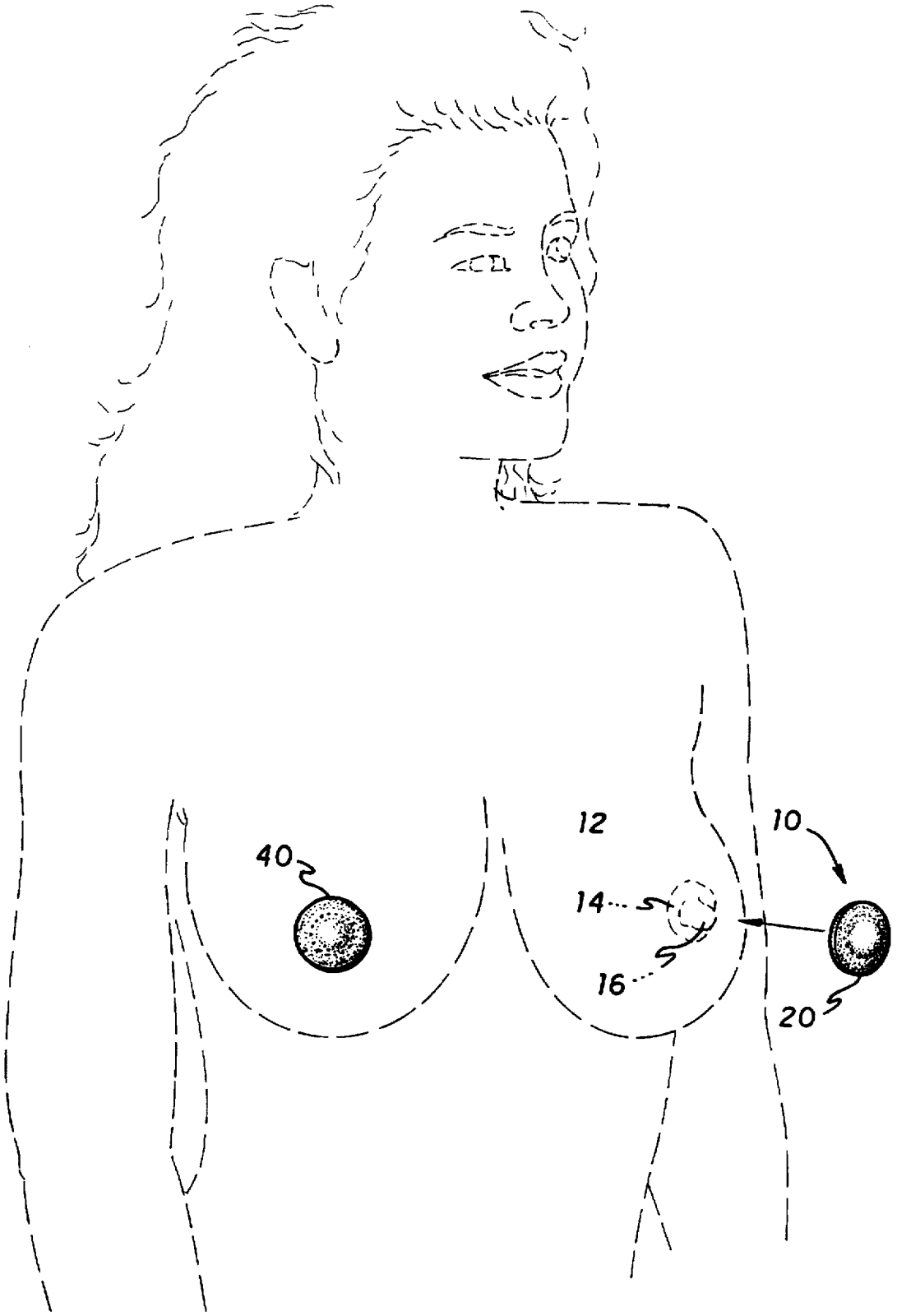
FIG. 1 is an environmental, perspective view of the nipple pads of the present invention.
Figure 2:
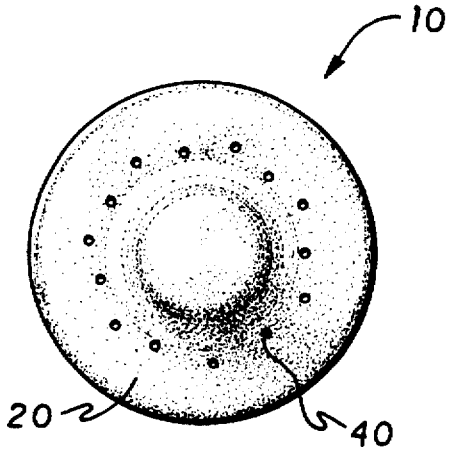
FIG. 2 is a front elevational view of one of the nipple pads as shown in FIG. 1.
Figure 3:
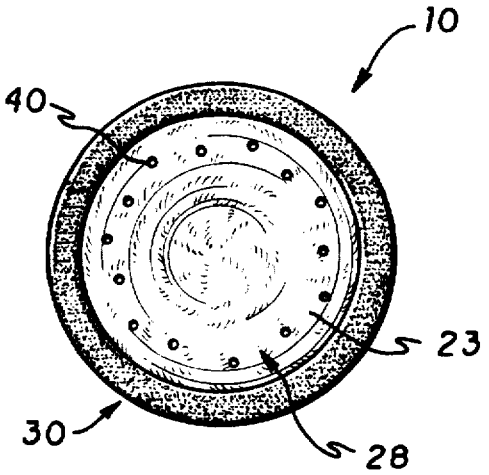
FIG. 3 is a rear elevational view of the nipple pad without the release liner and the padded liner.

As shown in FIGS. 1–5, the nipple pad 10 includes a pliable cover 20 having an inner surface 23, an opposite outer surface 21, a central portion 28, and a periphery 30. A padded liner 24 having a nipple receiving surface 34 and an attachment surface 36 is disposed on central portion 28 of cover 20. Attachment surface 36 of padded liner 24 contacts central portion 28. An adhesive strip 26 is disposed on periphery 30 of cover 20, concentrically surrounding padded liner 24. A release liner 22 is affixed to adhesive strip 26 for protecting both padded liner 24 and adhesive strip 26. Nipple receiving surface 34 of padded liner 24 contacts release liner 22.

Referring to FIG. 1, nipple pad 10 is preferably configured to comfortably conform to the nipple 16 and the areola 14 of a woman's breast 12. In particular, central portion 28 of cover 20 and nipple receiving surface 34 of padded liner 24 have a conical or concave shape for receiving the nipple 16, resulting in enhanced contouring and softening thereof. Padded liner 24 preferably has an increasing thickness from the periphery 30 to the central portion 28 of cover 20, resulting in maximum softening and protecting of the nipple 16. Furthermore, nipple pad 10 is preferably annular in shape for covering the areola 14. However, nipple pad 10 need not be limited to any specific shape.

In the preferred embodiment, cover 20 includes a plurality of breathing holes 40 and has a flesh tone color. Other embodiments include a nipple pad made of transparent materials or vividly colored materials. Cover 20 is preferably made from a pliable material, such as latex or other elastic polymeric substance. Padded liner 24 is made from a supple, conforming material that softens the rigid contours of the nipple, such as gauze or latex foam.

Further, the adhesive component of adhesive strip 26 is chosen so that the nipple pad 10 can be removed from the nipple 16 and areola 14 without leaving a residue or causing pain. For example, a breathable, FDA approved, pressure-sensitive adhesive could be used. Release liner 22 is preferably a single sheath continuously covering adhesive strip 26 and padded liner 24; however, alternative embodiments include a plurality of release liner portions, each with pull tabs for facilitating removal of liner 24.

Figure 4:
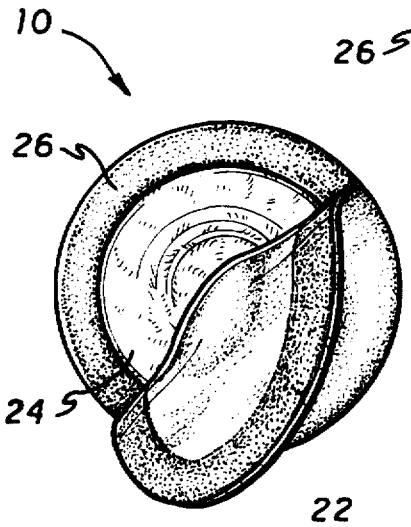
FIG. 4 is a rear perspective view of the nipple pad with the release liner partially removed to show the annular adhesive strip and the padded liner.
Figure 5:
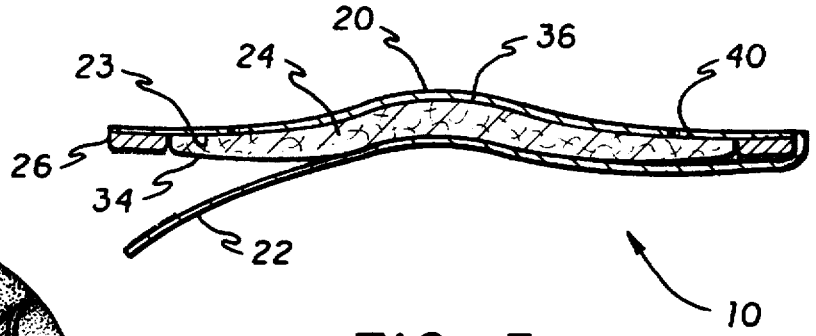
FIG. 5 is a side elevational view of the nipple pad.

With reference to FIGS. 4 and 5, the user employs nipple pad. 10 by peeling off release liner 22 to expose adhesive strip 26 and nipple and areola receiving surface 34 of padded liner 24. As depicted in FIG. 1, the user places nipple pad 10 over the areola 14 and nipple 16 of the breast 12. The adhesive strip 26 is affixed to the surface of the skin, thereby permitting the user to eliminate encumbering and uncomfortable straps of brassieres. It is primarily intended that the present invention be worn underneath a variety of garments such as swim suits or closely fitting T-shirts and tank tops, casual wear, dress and career fashions, and elegant evening wear. However, alternative decorative embodiments of the present invention permit the user to sunbathe topless; if so; the nipple pad 10 provides important sun protection.

It is to be understood that the nipple pad is not limited to the embodiments described above, but encompasses any and all embodiments within the scope of the following claims.

I claim:

1. A nipple pad for protecting and concealing a nipple and an areola of a breast of a woman, said nipple pad comprising:

a pliable latex cover having an outer surface, an opposing inner surface, a concave central portion, and a substantially flat periphery concentrically surrounding said central portion, said pliable cover having a plurality of breathing holes passing therethrough;

a concave padded liner having a nipple receiving surface and an attachment surface, said attachment surface being connected to said inner surface of said pliable cover at said central portion, said padded liner and said pliable cover formed of supple material to conform to a nipple of a breast of a woman;

said padded lined has a thickness which increases from said periphery to said central portion of the pliable cover an adhesive strip affixed to said inner surface of said pliable cover at said periphery; and, a protective release liner attached to said adhesive strip for protecting said adhesive strip and said nipple receiving surface of said padded liner until a user removes said protective release liner.

2. The nipple pad according to claim 1, wherein said padded liner is made of a latex foam material.

3. The nipple pad according to claim 1, wherein said pliable cover has a skin-toned color.

4. The nipple pad according to claim 1 wherein said release liner comprises a single sheath continuously covering said adhesive strip and said padded liner.

* * * * *